US007100401B2

(12) United States Patent
Yu

(10) Patent No.: US 7,100,401 B2
(45) Date of Patent: Sep. 5, 2006

(54) PADLOCK HAVING AN IDENTIFICATION FUNCTION

(76) Inventor: Chun Te Yu, No.253, Sec. 3, Yanhai Rd., Fusing Township, Changhua County 506 (TW)

( * ) Notice: Subject to any disclaimer, the term of this patent is extended or adjusted under 35 U.S.C. 154(b) by 44 days.

(21) Appl. No.: 11/032,116

(22) Filed: Jan. 11, 2005

(65) Prior Publication Data

US 2006/0107710 A1 May 25, 2006

(30) Foreign Application Priority Data

Nov. 23, 2004 (TW) ..... 93218813 U

(51) Int. Cl.
*E05B 37/06* (2006.01)
*E05B 41/00* (2006.01)

(52) U.S. Cl. ..... 70/21; 70/25; 70/432; 70/435; 70/437

(58) Field of Classification Search ..... 70/20–49, 70/432, 441, 435, 16, 437
See application file for complete search history.

(56) References Cited

U.S. PATENT DOCUMENTS

| | | | | |
|---|---|---|---|---|
| 7,007,521 | B1 * | 3/2006 | Misner et al. | 70/21 |
| 2002/0088256 | A1 * | 7/2002 | Taylor et al. | 70/25 |
| 2004/0226324 | A1 * | 11/2004 | Loughlin et al. | 70/25 |
| 2005/0092036 | A1 * | 5/2005 | Lai | 70/25 |
| 2005/0262903 | A1 * | 12/2005 | Ling et al. | 70/21 |

* cited by examiner

*Primary Examiner*—Brian E. Glessner
*Assistant Examiner*—William Schrode

(74) *Attorney, Agent, or Firm*—Rosenberg, Klein & Lee

(57) ABSTRACT

A padlock includes a housing, a shackle, a number lock mechanism, a key lock mechanism, a movable block, and an identification member. Thus, the identification member is exposed outward from the window of the limit knob after the padlock has been unlocked by an inspector of the customs for checking the luggage so as to remind a user to inspect if contents of the luggage that has been opened and checked are missed or lost.

8 Claims, 12 Drawing Sheets

PADLOCK HAVING AN IDENTIFICATION FUNCTION

BACKGROUND OF THE INVENTION

1. Field of the Invention

The present invention relates to a padlock, and more particularly to a padlock having an identification function so as to remind a user to inspect the luggage.

2. Description of the Related Art

A conventional dual lock in accordance with the prior art was disclosed in the Taiwanese Patent Publication No. 590146 and comprises a housing, a shackle mounted on the housing, a first locking mechanism mounted on the housing to lock and unlock the shackle, and a second locking mechanism mounted on the housing to lock and unlock the shackle. The first locking mechanism can be opened by the user only, and the second locking mechanism can be opened by a specified key. The specified key is often held by an inspector of the customs, so that the inspector can directly unlock the second locking mechanism of the padlock by the specified key so as to open and check a luggage locked by the padlock without having to break the padlock for checking the luggage. Then, the inspector can lock the second locking mechanism of the padlock by the specified key so as to lock the luggage by the padlock again. However, the user cannot directly judge if the padlock has been unlocked by the inspector for opening and checking the luggage, so that the user has to unlock multiple padlocks to inspect each piece of luggage so as to judge if the luggage has been opened and checked, thereby causing inconvenience to the user.

SUMMARY OF THE INVENTION

The primary objective of the present invention is to provide a padlock having an identification function so as to remind a user to inspect the luggage.

Another objective of the present invention is to provide a padlock, wherein the identification member is exposed outward from the window of the limit knob after the padlock has been unlocked by an inspector of the customs for checking the luggage so as to remind a user to inspect if contents of the luggage that has been opened and checked are missed or lost.

A further objective of the present invention is to provide a padlock, wherein the user can directly and easily judge if the padlock has been unlocked for checking the luggage, so that the user only needs to inspect the luggage that has been opened and checked without having to inspect the luggage that has never been opened.

In accordance with one embodiment of the present invention, there is provided a padlock, comprising:

a housing;

a shackle mounted on the housing and having a first end formed with a pivot shaft movably mounted in the housing and a second end formed with a locking portion moved with the pivot shaft and extended outward from the housing;

a number lock mechanism mounted in the housing to lock and unlock the pivot shaft of the shackle;

a key lock mechanism mounted on the housing and including a lock core rotatably mounted in the housing, and a limit knob located outside of the housing and rotated by rotation of the lock core, wherein the limit knob has a window;

a movable block movably mounted in the limit knob of the key lock mechanism, wherein when the limit knob is moved away to release the locking portion of the shackle, the movable block is moved to an identification position synchronously;

an identification member mounted on the movable block and directed toward the window of the limit knob, wherein when the movable block is moved to the identification position thereof, the identification member is aligned with and exposed outward from the window of the limit knob.

In accordance with another embodiment of the present invention, there is provided a padlock, comprising:

a housing;

a shackle mounted on the housing and having a first end formed with a pivot shaft movably mounted in the housing and a second end formed with a locking portion moved with the pivot shaft and extended outward from the housing, wherein a gap is defined between a distal end of the locking portion of the shackle and the housing;

a number lock mechanism mounted in the housing to lock and unlock the pivot shaft of the shackle;

a key lock mechanism mounted on the housing and including a lock core rotatably mounted in the housing, and a limit knob located outside of the housing and moved by rotation of the lock core, wherein the limit knob has a window and detachably received in the gap;

a movable block movably mounted in the limit knob of the key lock mechanism, wherein when the limit knob is moved away from the gap, the movable block is moved to an identification position synchronously;

an identification member mounted on the movable block and directed toward the window of the limit knob, wherein when the movable block is moved to the identification position thereof, the identification member is aligned with and exposed outward from the window of the limit knob.

Further benefits and advantages of the present invention will become apparent after a careful reading of the detailed description with appropriate reference to the accompanying drawings.

DETAILED DESCRIPTION OF THE INVENTION

Figure 1:
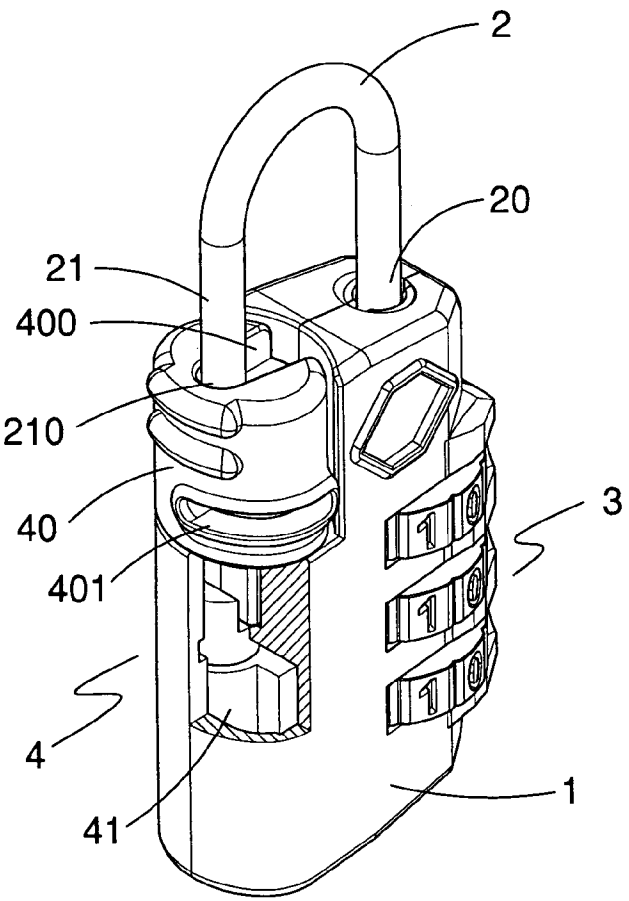
FIG. 1 is a perspective view of a padlock in accordance with the first preferred embodiment of the present invention.

Referring to the drawings and initially to FIG. 1, a padlock in accordance with the first preferred embodiment of the present invention comprises a housing 1, a shackle 2, a n umber lock mechanism 3, and a key lock mechanism 4.

The shackle 2 is substantially U-shaped and mounted on the housing 1. The shackle 2 has a first end formed with a pivot shaft 20 pivotally mounted in and axially movable relative to the housing 1 and a second end formed with a locking portion 21 moved with the pivot shaft 20 and extended outward from the housing 1.

The number lock mechanism 3 is mounted in the housing 1 to lock and unlock the pivot shaft 20 of the shackle 2.

The key lock mechanism 4 includes a lock core 41 mounted in the housing 1 and rotated by a matching key (not shown), and a limit knob 40 located outside of the housing 1 and rotated by rotation of the lock core 41.

The limit knob 40 of the key lock mechanism 4 has a top face formed with a receiving recess 400 to receive a distal end 210 of the locking portion 21 of the shackle 2 and having an opening extended to a periphery of the limit knob 40.

The limit knob 40 of the key lock mechanism 4 has a side face formed with a window 401.

Figure 2:
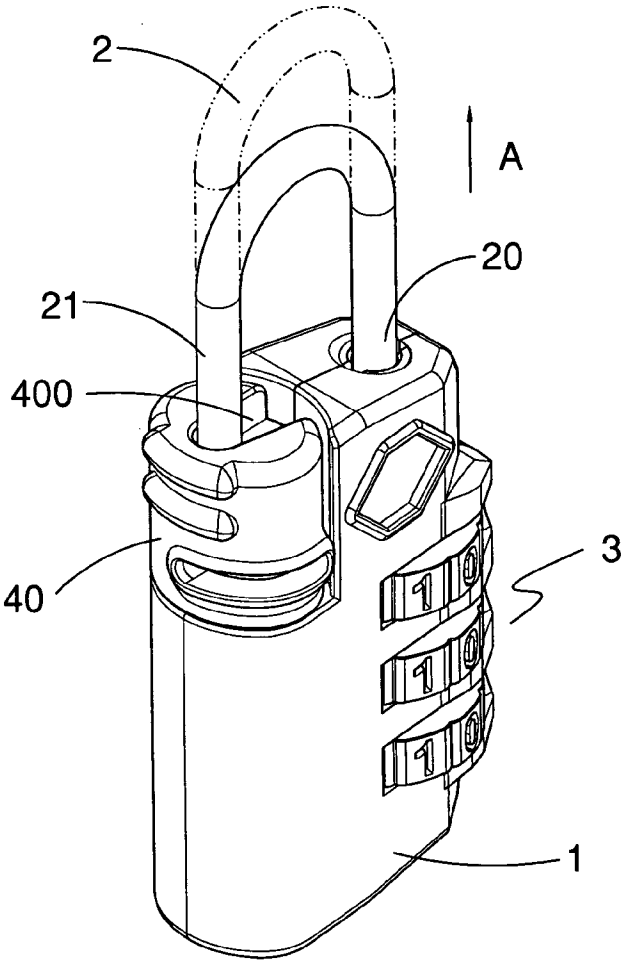
FIG. 2 is a schematic operational view of the padlock as shown in FIG. 1.

Referring to FIG. 2, when the opening of the receiving recess 400 of the limit knob 40 is directed toward and sealed by the housing 1, the locking portion 21 of the shackle 2 is extended into and stopped by the receiving recess 400 of the limit knob 40 of the key lock mechanism 4, so that the shackle 2 is stopped by the limit knob 40, thereby forming a locked state. When the number lock mechanism 3 is unlocked, the pivot shaft 20 of the shackle 2 is unlocked from the number lock mechanism 3, so that the shackle is movable outward in the direction as indicated by the arrow "A" so as to detach the locking portion 21 of the shackle 2 from the receiving recess 400 of the limit knob 40 of the key lock mechanism 4, thereby forming an unlocked state.

Figure 3:
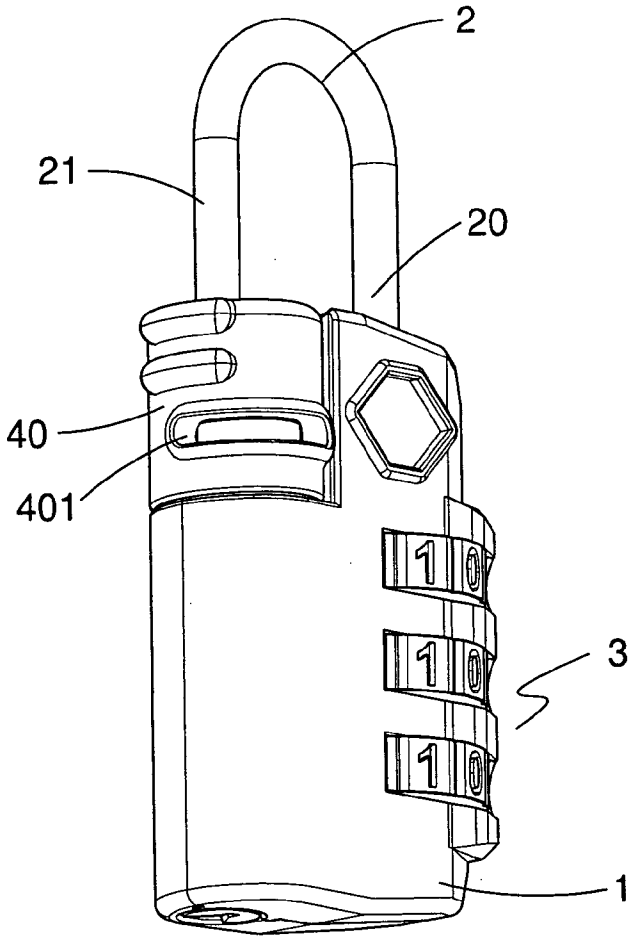
FIG. 3 is a perspective view of the padlock as shown in FIG. 1.

Referring to FIG. 3, when the number lock mechanism 3 is locked, the pivot shaft 20 of the shackle 2 is locked by the number lock mechanism 3, so that the locking portion 21 of the shackle 2 is stopped by the limit knob 40, thereby forming a locked state.

Figure 4:
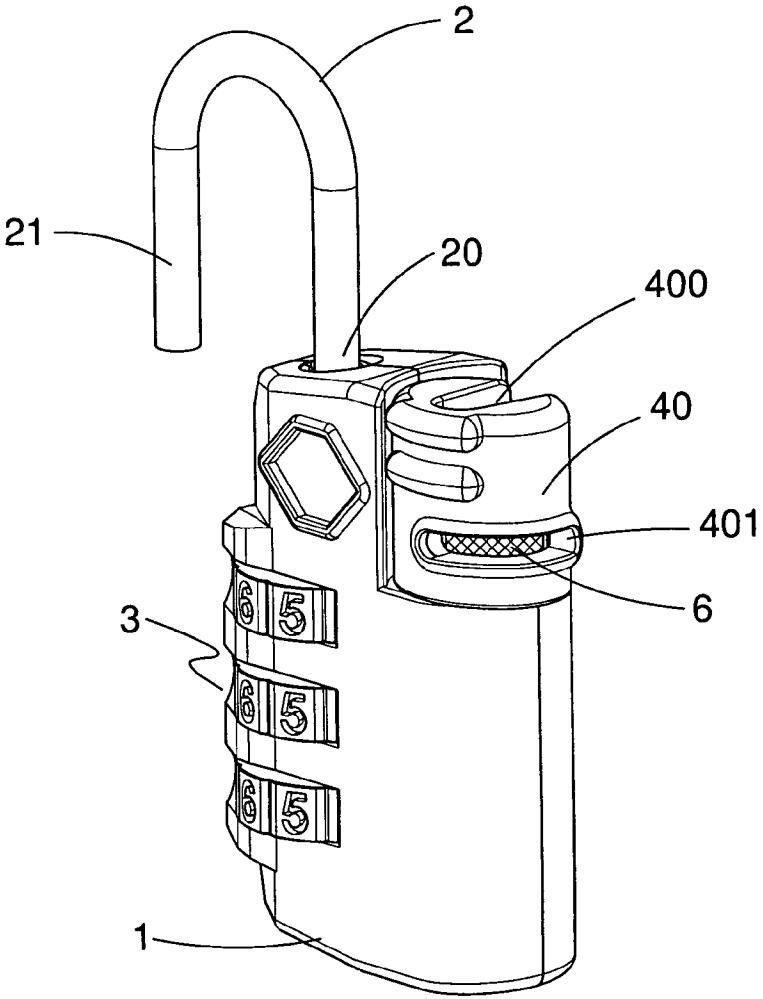
FIG. 4 is a schematic operational view of the padlock as shown in FIG. 1.

Referring to FIG. 4, when the lock core 41 of the key lock mechanism 4 is rotated by the matching key, the limit knob 40 is rotated by the lock core 41 until the opening of the receiving recess 400 of the limit knob 40 is released from the housing 1, so that the locking portion 21 of the shackle 2 is released from the receiving recess 400 of the limit knob 40 and is rotated freely about the pivot shaft 20 of the shackle 2, thereby forming an unlocked state.

Figure 5:
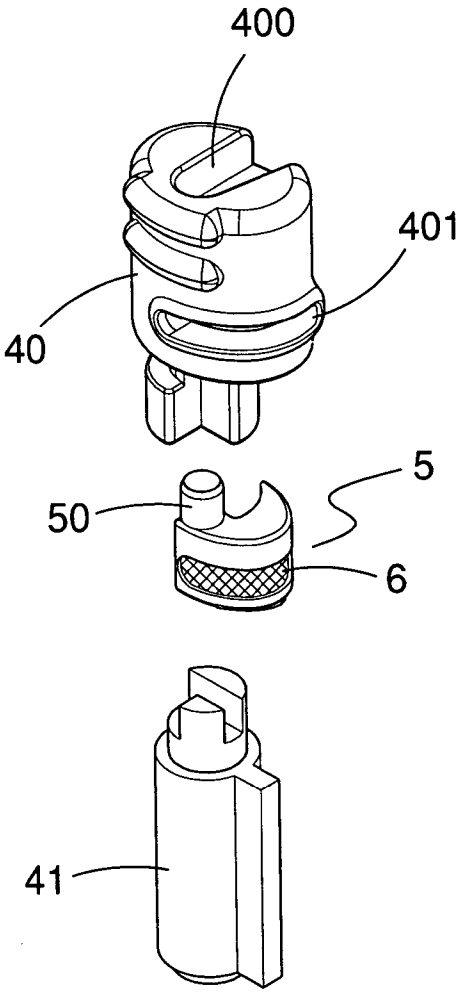
FIG. 5 is a partially exploded perspective view of the padlock as shown in FIG. 1.

Referring to FIG. 5, a movable block 5 is movably mounted in the limit knob 40 of the key lock mechanism 4 and has a first side provided with a protruding shaft bolt 50 directed toward the limit knob 40. An identification member 6 is mounted on the movable block 5 and is directed toward the window 401 of the limit knob 40. Preferably, the identification member 6 is a color, character, number or pattern. For example, the identification member 6 has a red color, and the movable block 5 has a green color, so that the window 401 of the limit knob 40 presents a red color of the identification member 6 at the unlocked state and presents a green color of the movable block 5 at the locked state.

Figure 6:
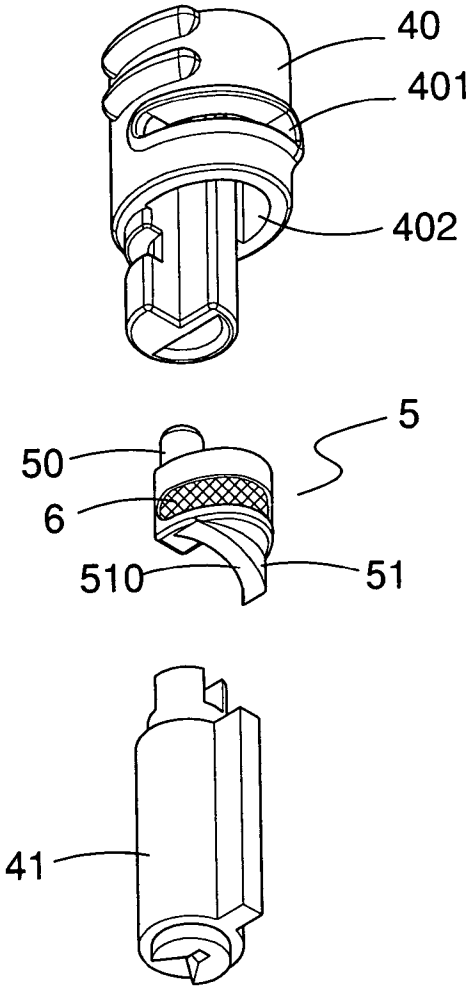
FIG. 6 is a partially exploded perspective view of the padlock as shown in FIG. 1.

Referring to FIG. 6, the limit knob 40 is formed with a chamber 402 facing the housing 1 to receive the movable block 5. The movable block 5 has a second side provided with a guide portion 51 formed with a first ramp 510.

Figure 7:
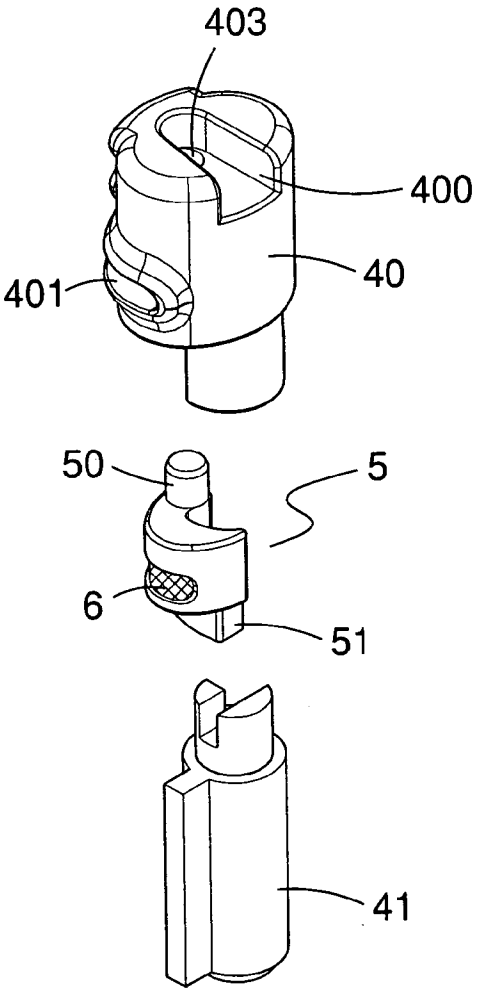
FIG. 7 is a partially exploded perspective view of the padlock as shown in FIG. 1.

Referring to FIG. 7, the receiving recess 400 of the limit knob 40 has a shaft hole 403 connected to the chamber 402, and the shaft bolt 50 of the movable block 5 is extended into the shaft hole 403 of the limit knob 40.

Figure 8:
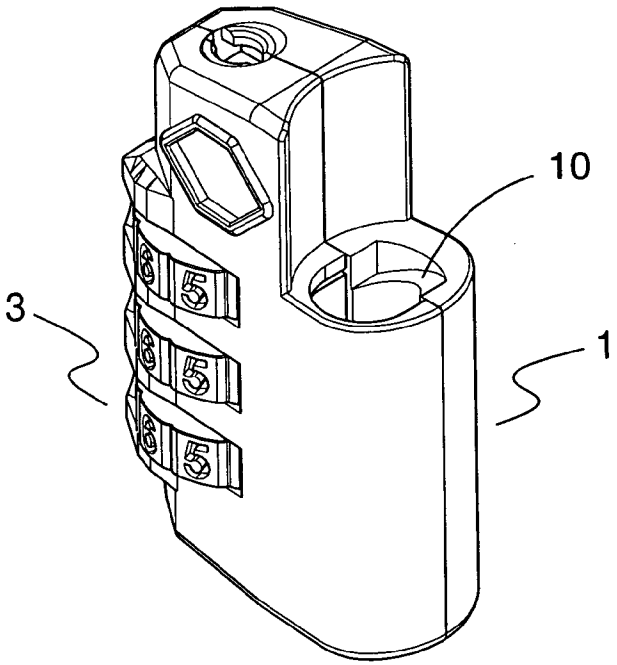
FIG. 8 is a partially perspective view of the padlock as shown in FIG. 1.

Referring to FIG. 8, the housing 1 is formed with a second ramp 10 complementarily touchable with the first ramp 510 of the guide portion 51 of the movable block 5.

Figure 9:
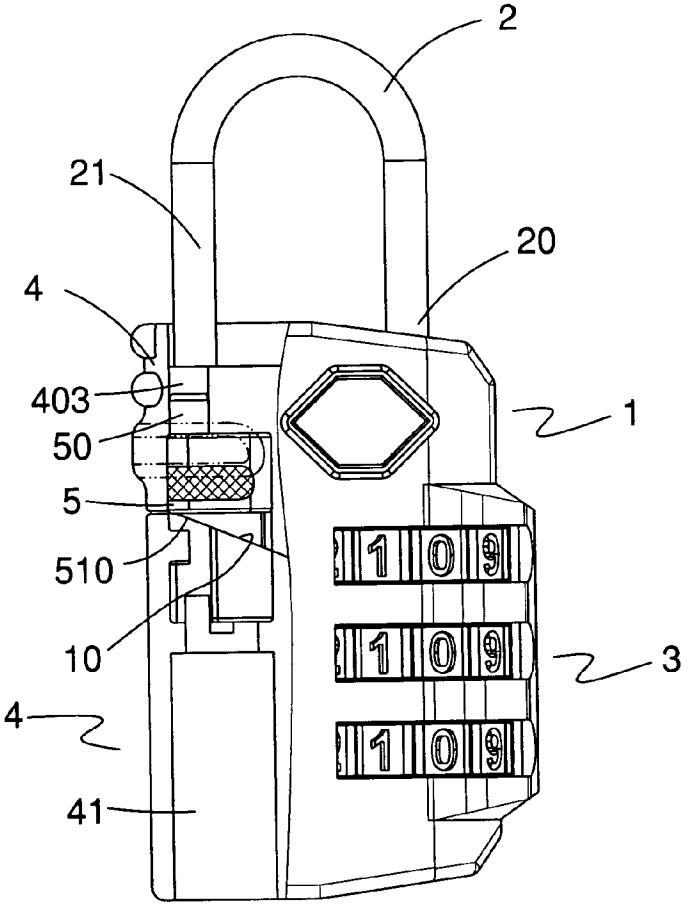
FIG. 9 is a plan view of the padlock as shown in FIG. 1.

Referring to FIG. 9, the first ramp 510 of the movable block 5 and the second ramp 10 of the housing 1 complementarily touch each other, so that the identification member 6 is hidden in the housing 1 and detached from the window 401 of the limit knob 40, which indicates that the key lock mechanism 4 has not been opened.

Figure 10:
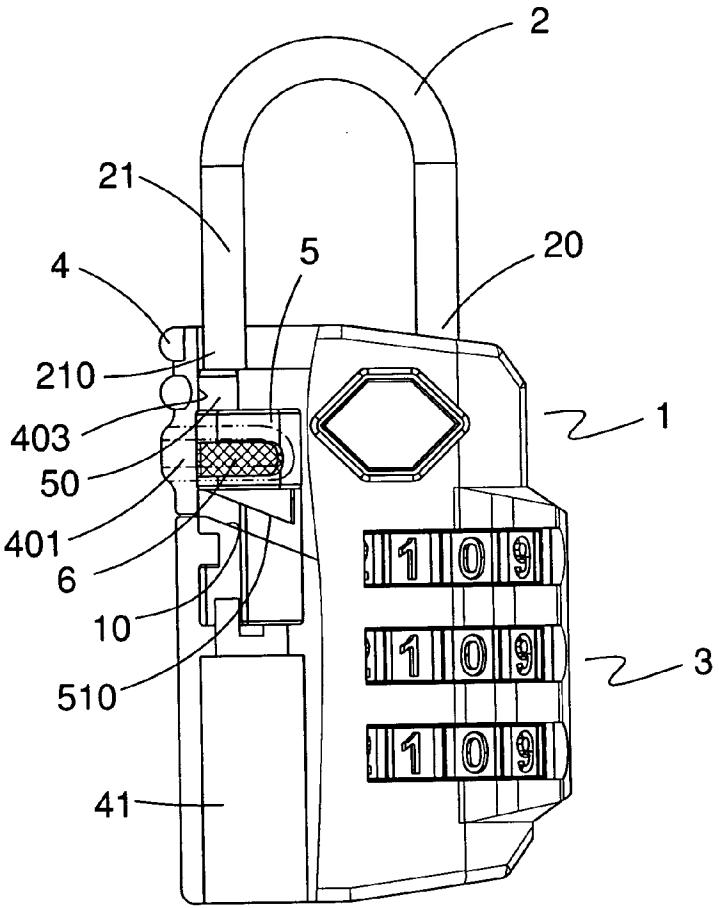
FIG. 10 is a schematic operational view of the padlock as shown in FIG. 9.

Referring to FIG. 10, when the lock core 41 of the key lock mechanism 4 is rotated by the matching key, the limit knob 40 is rotated by the lock core 41 until the opening of the receiving recess 400 of the limit knob 40 is released from the housing 1, so that the locking portion 21 of the shackle 2 is released from the receiving recess 400 of the limit knob 40 and is rotated freely about the pivot shaft 20 of the shackle 2, thereby forming an unlocked state. At this time, the shaft bolt 50 of the movable block 5 is extended into the shaft hole 403 of the limit knob 40, so that when the limit knob 40 is rotated by the lock core 41, the movable block 5 is driven by the limit knob 40. In such a manner, the movable block 5 is lifted to an identification position by engagement between the first ramp 510 of the movable block 5 and the second ramp 10 of the housing 1, so that the identification member 6 is exposed outward from the window 401 of the limit knob 40.

After the limit knob 40 is again rotated by the lock core 41 to lock the locking portion 21 of the shackle 2, the movable block 5 is pressed by the chamber 402 and the shaft hole 403 of the limit knob 40, so that the movable block 5 is not moved with the limit knob 40 and still kept at the identification position thereof, which indicates that the key lock mechanism 4 has been opened.

When the number lock mechanism 3 is unlocked, the distal end 210 of the locking portion 21 of the shackle 2 is pressed downward to extend into the shaft hole 403 of the limit knob 40 to push the shaft bolt 50 of the movable block 5 downward, so that the movable block 5 is pushed to move away from the identification position thereof.

Alternatively, the shackle 2 is pulled outward and is rotated to move away from the limit knob 40. Then, a tool (not shown) is extend into the shaft hole 403 of the limit knob 40 to push the shaft bolt 50 of the movable block 5 downward, so that the movable block 5 is pushed to move away from the identification position thereof.

As shown in FIG. 3, the shackle 2 is limited by the limit knob 40, thereby forming a locked state. At this time, the identification member 6 is detached from the window 401 of the limit knob 40.

As shown in FIG. 4, the limit knob 40 is rotated by the lock core 41 until the opening of the receiving recess 400 of the limit knob 40 is released from the housing 1, so that the locking portion 21 of the shackle 2 is released from the receiving recess 400 of the limit knob 40 and is rotated freely about the pivot shaft 20 of the shackle 2, thereby forming an unlocked state. At this time, the identification member 6 is exposed outward from the window 401 of the limit knob 40 to remind a user that the key lock mechanism 4 has been opened.

Figure 11:
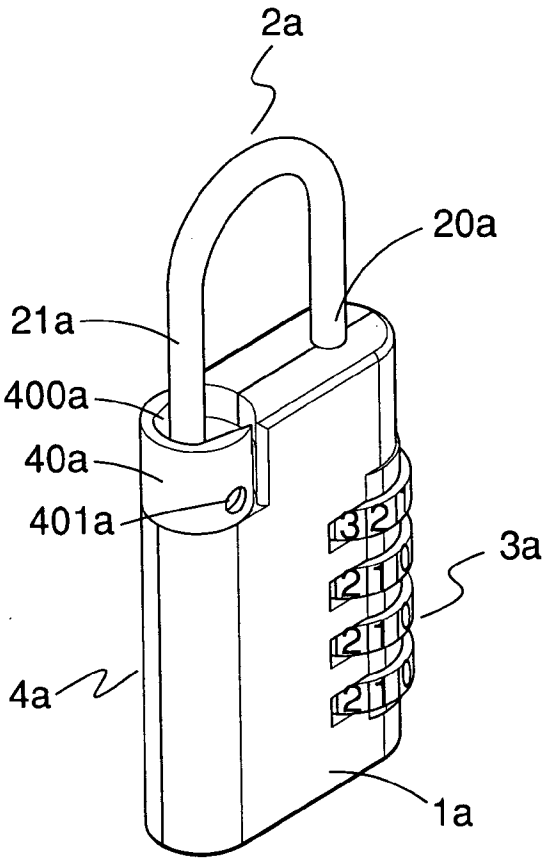
FIG. 11 is a perspective view of a padlock in accordance with the second preferred embodiment of the present invention.

Referring to FIG. 11, a padlock in accordance with the second preferred embodiment of the present invention has a structure substantially similar to that of the first preferred embodiment.

Figure 12:
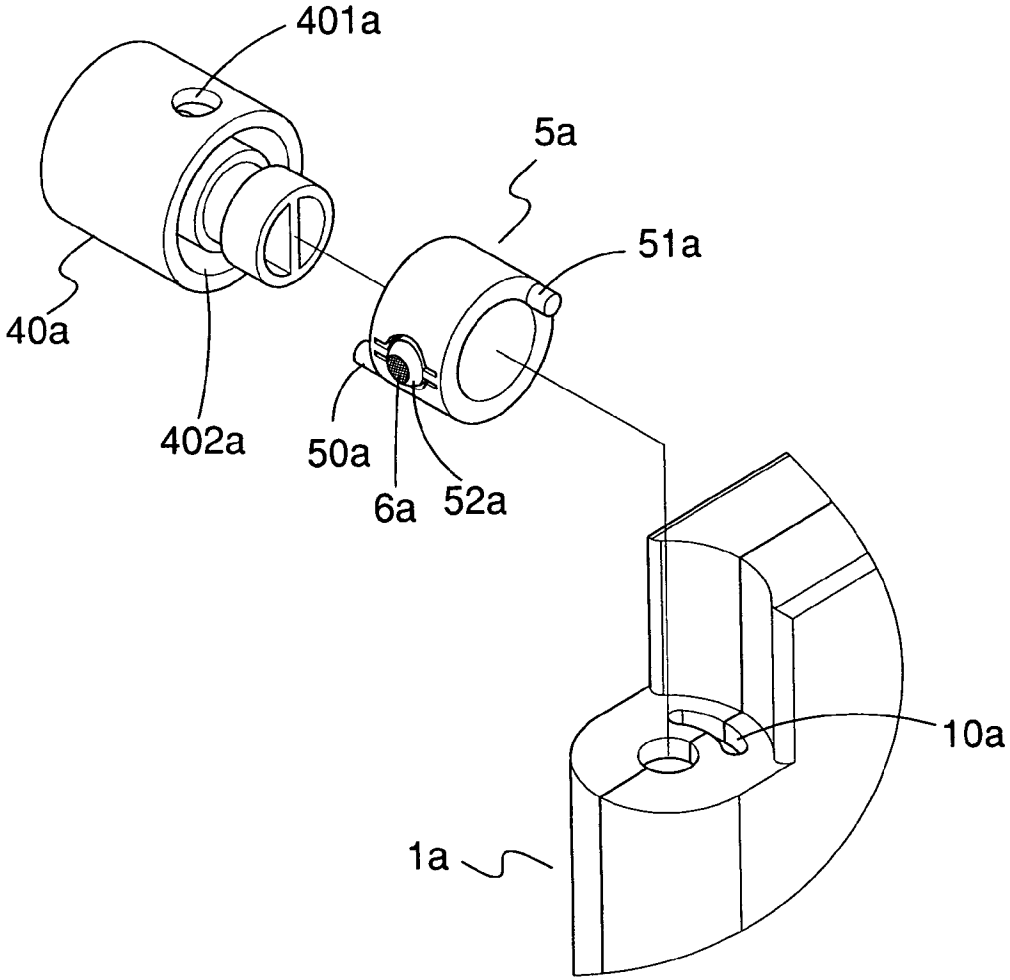
FIG. 12 is a partially exploded perspective view of the padlock as shown in FIG. 11.

Referring to FIG. 12, the housing 1*a* is formed with an arc-shaped limit slot 10*a*, and the movable block 5*a* has a first side provided with a first protruding post 50*a* and a second side provided with a second protruding post 51*a* slidably mounted in the limit slot 10*a* of the housing 1*a*: The movable block 5*a* has a periphery provided with an elastic protrusion 52*a* corresponding to the window 401*a* of the limit knob 40*a*, and the identification member 6*a* is mounted on the elastic protrusion 52*a*.

Figure 13:
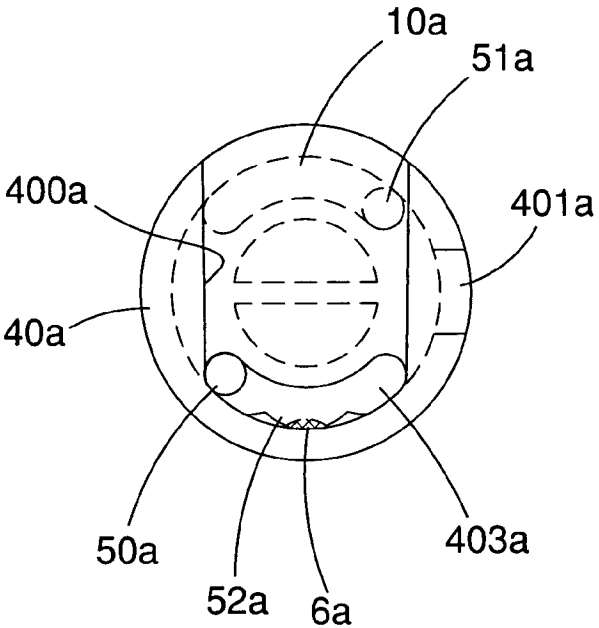
FIG. 13 is a top plan view of the padlock as shown in FIG. 11.

Referring to FIG. 13, the receiving recess 400*a* of the limit knob 40*a* is formed with an arc-shaped guide slot 403*a* connected to the chamber 402*a*, and the first protruding post 50*a* of the movable block 5*a* is slidably mounted in the guide slot 403*a* of the limit knob 40*a*.

Figure 14:
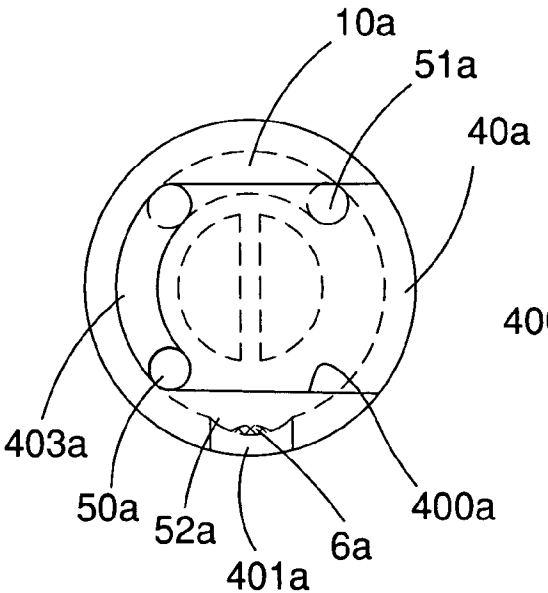
FIG. 14 is a schematic operational view of the padlock as shown in FIG. 13.

Referring to FIG. 14, the limit knob 40*a* is rotated clockwise, so that the receiving recess 400*a* of the limit knob 40*a* is located at the opened or unlocked state. At this time, the second protruding post 5 1*a* of the movable block 5*a* is limited by a terminal side of the limit slot 10*a* of the housing 1*a*, so that the movable block 5*a* is not moved with the limit knob 40*a*, while the window 401*a* of the limit knob 40*a* is moved with the limit knob 40*a* to align with the elastic protrusion 52*a*, so that the identification member 6*a* is exposed outward from the window 401*a* of the limit knob 40*a*.

Figure 15:
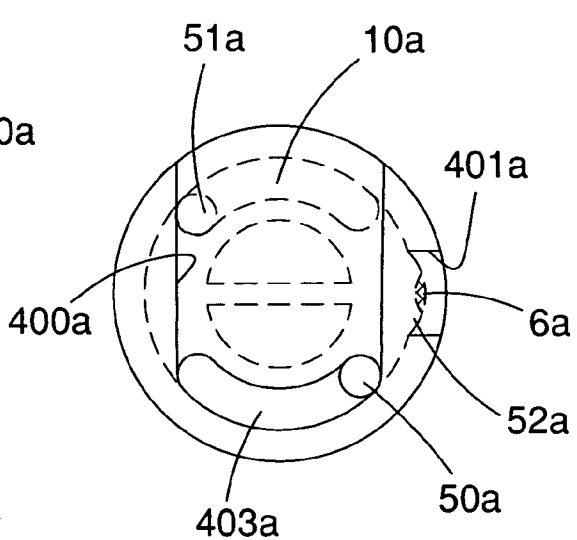
FIG. 15 is a schematic operational view of the padlock as shown in FIG. 14.

Referring to FIG. 15, the limit knob 40*a* is rotated counterclockwise to return to the original position, so that the receiving recess 400*a* of the limit knob 40*a* is located at the closed or locked state. At this time, the elastic protrusion 52*a* is inserted into the window 401*a* of the limit knob 40*a*, so that the movable block 5*a* is moved with the limit knob 40*a*, and the identification member 6*a* is still exposed outward from the window 40 1*a* of the limit knob 40*a*, which indicates that the key lock mechanism 4*a* has been opened.

When the number lock mechanism 3*a* is unlocked, the shackle 2*a* is pulled outward and is rotated to move away from the limit knob 40*a*: Then, a tool (not shown) is extend into the guide slot 403*a* of the limit knob 40*a* to push the first protruding post 50*a* of the movable block 5*a* to return to its original position, so that the identification member 6*a* is detached from the window 401*a* of the limit knob 40*a* and is hidden in the limit knob 40*a*.

Figure 16:
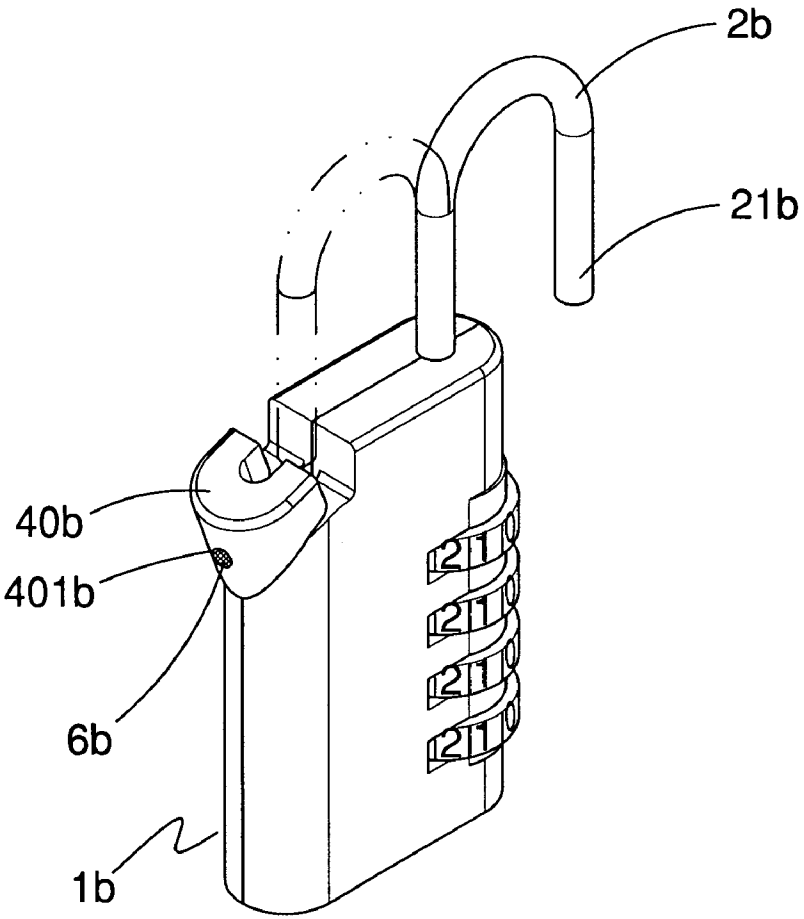
FIG. 16 is a perspective operational view of a padlock in accordance with the third preferred embodiment of the present invention.

Referring to FIG. 16, a padlock in accordance with the third preferred embodiment of the present invention has a structure substantially similar to that of the first preferred embodiment. The limit knob 40*b* is pivotally mounted on an upper side of the housing 1*b* to limit the locking portion 21*b* of the shackle 2*b*, so that the locking portion 21*b* of the shackle 2*b* is disposed at a locked state, or to release the locking portion 21*b* of the shackle 2*b*, so that the locking portion 21*b* of the shackle 2*b* is disposed at an unlocked state. When the locking portion 21*b* of the shackle 2*b* is disposed at the unlocked state, the identification member 6*b* is moved with the limit knob 40*b* and is exposed outward from the window 401*b* of the limit knob 40*b*.

Figure 17:
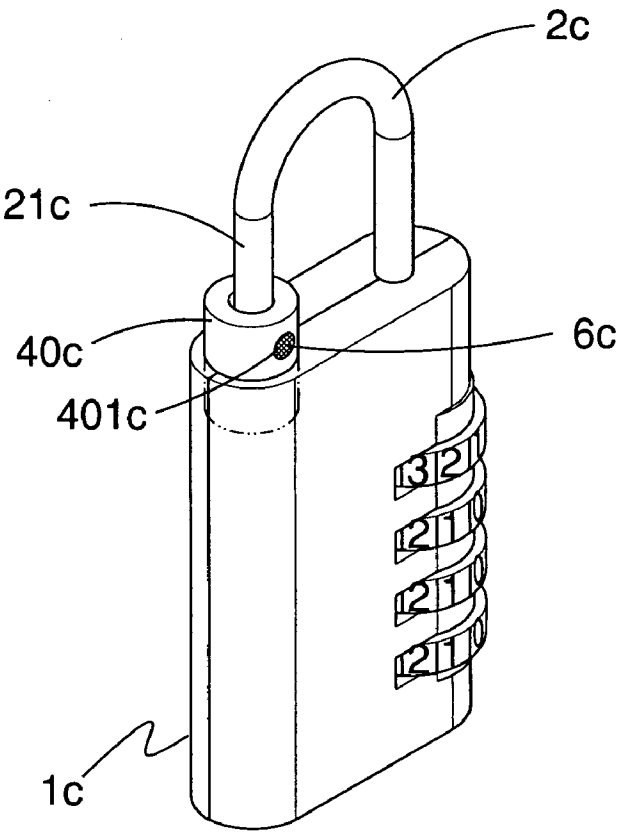
FIG. 17 is a perspective view of a padlock in accordance with the fourth preferred embodiment of the present invention.

Referring to FIG. 17, a padlock in accordance with the fourth preferred embodiment of the present invention has a structure substantially similar to that of the first preferred embodiment. The limit knob 40*c* is retractably mounted on an upper side of the housing 1*c* to limit the locking portion 21*c* of the shackle 2*c*, so that the locking portion 21*c* of the shackle 2*c* is disposed at a locked state, or to release the locking portion 21*c* of the shackle 2*c*, so that the locking portion 21*c* of the shackle 2*c* is disposed at an unlocked state. When the locking portion 21*c* of the shackle 2*c* is disposed at the unlocked state, the identification member 6*c* is moved with the limit knob 40*c* and is exposed outward from the window 401*c* of the limit knob 40*c*.

Figure 19:
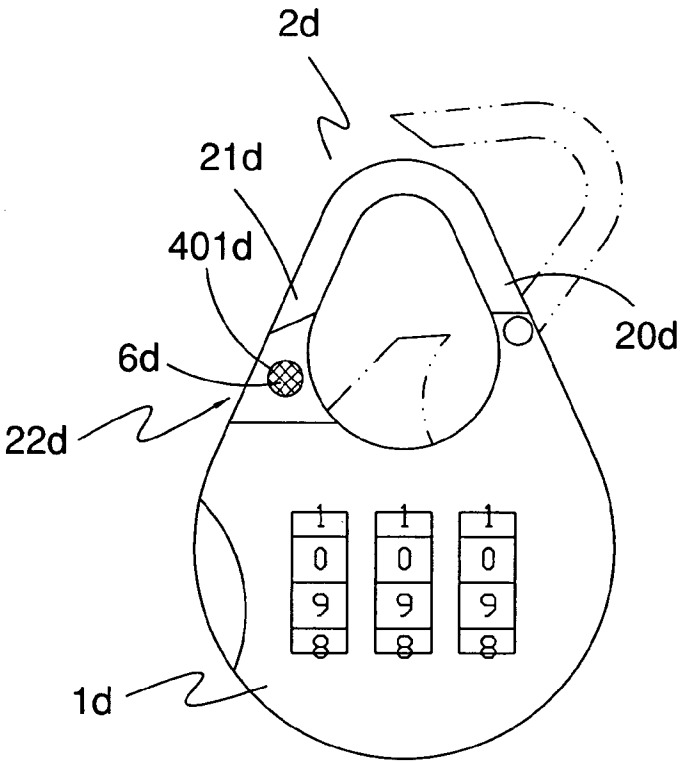
FIG. 19 is a front plan operational view of the padlock as shown in FIG. 1.
Figure 18:
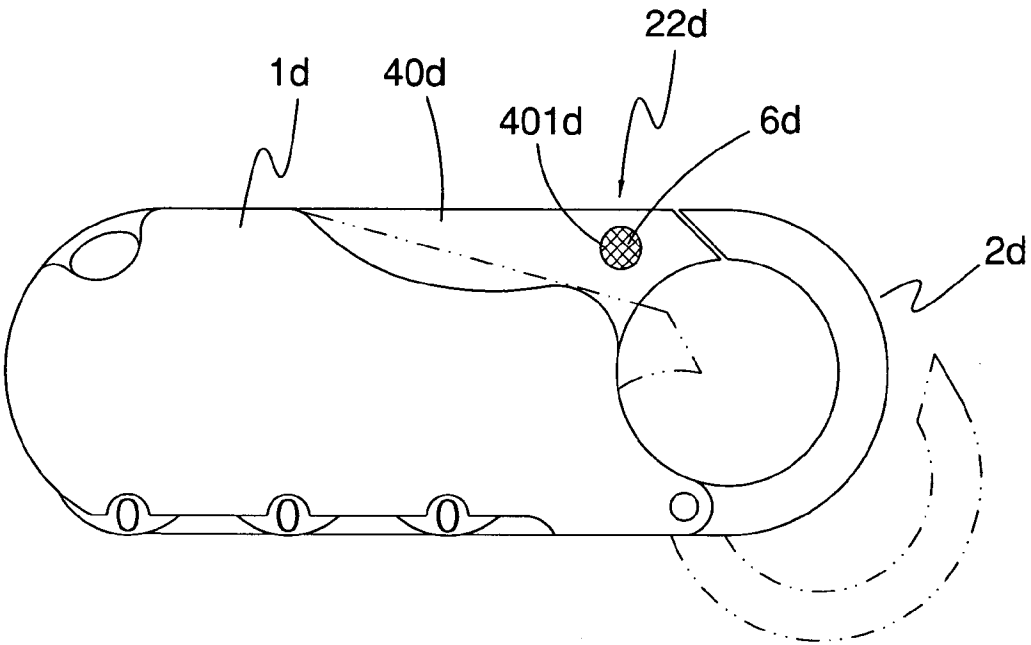
FIG. 18 is a top plan operational view of a padlock in accordance with the fifth preferred embodiment of the present invention.

Referring to FIGS. 18 and 19, a padlock in accordance with the fifth preferred embodiment of the present invention has a structure substantially similar to that of the first preferred embodiment. The pivot shaft 20*d* of the shackle 2*d* is pivotally mounted on a side of the housing 1*d*, and a gap 22*d* is defined between a distal end of the locking portion 21*d* of the shackle 2*d* and the housing 1*d*. The limit knob 40*d* is pivotally mounted on the housing 1*d* and received in the gap 22*d* to form a locked state. When the limit knob 40*d* is pressed to move toward the housing 1*d*, the gap 22*d* is opened to form an unlocked state, so that the identification member 6*d* is moved with the limit knob 40*d* and is exposed outward from the window 401*d* of the limit knob 40*d*.

Figure 20:
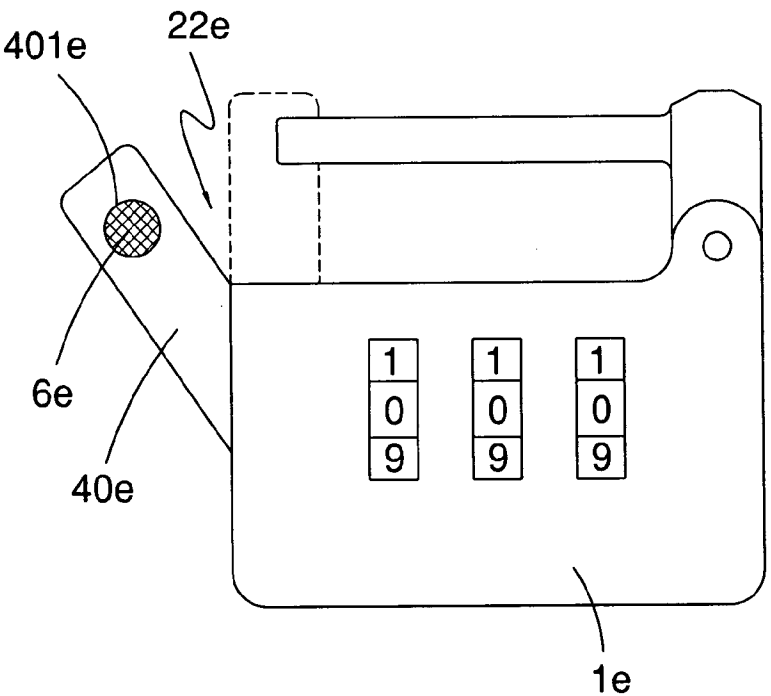
FIG. 20 is a front plan operational view of a padlock in accordance with the sixth preferred embodiment of the present invention.

Referring to FIG. 20, a padlock in accordance with the sixth preferred embodiment of the present invention has a structure substantially similar to that of the fifth preferred embodiment. The limit knob 40*e* is pivotally mounted on the housing 1*e* and received in the gap 22*e* to form a locked state. When the limit knob 40*e* is moved outward relative to the housing 1*e*, the gap 22*e* is opened to form an unlocked state, so that the identification member 6*e* is moved with the limit knob 40*e* and is exposed outward from the window 401*e* of the limit knob 40*e*.

Figure 21:
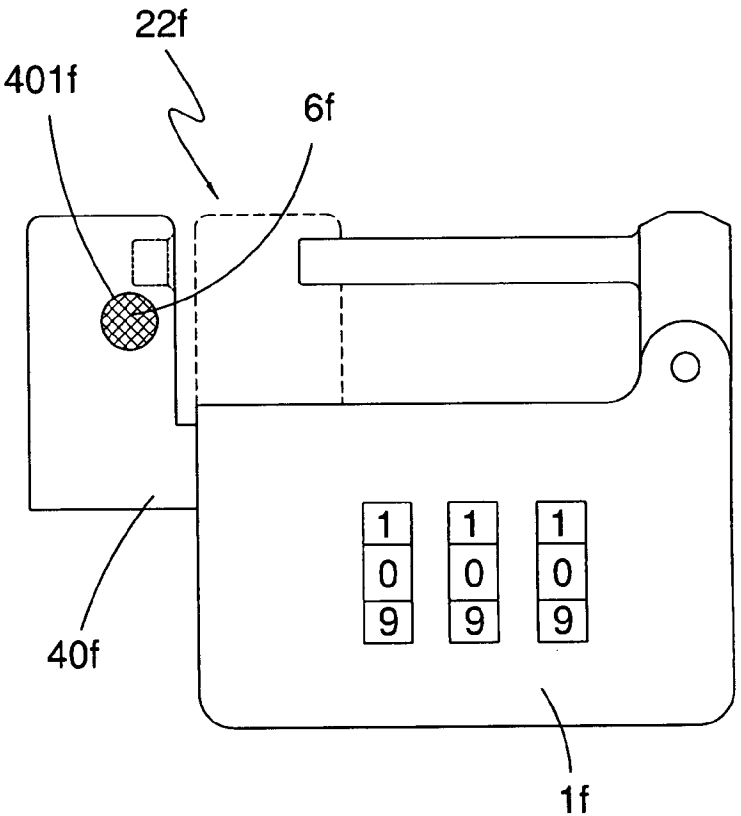
FIG. 21 is a front plan operational view of a padlock in accordance with the seventh preferred embodiment of the present invention.

Referring to FIG. 21, a padlock in accordance with the seventh preferred embodiment of the present invention has a structure substantially similar to that of the fifth preferred embodiment. The limit knob 40*f* is linearly and movably mounted on the housing 1*f* and received in the gap 22*f* to form a locked state. When the limit knob 40*f* is linearly moved outward relative to the housing 1*f*, the gap 22*f* is opened to form an unlocked state, so that the identification member 6*f* is moved with the limit knob 40*f* and is exposed outward from the window 401*f* of the limit knob 40*f*.

Figure 23:
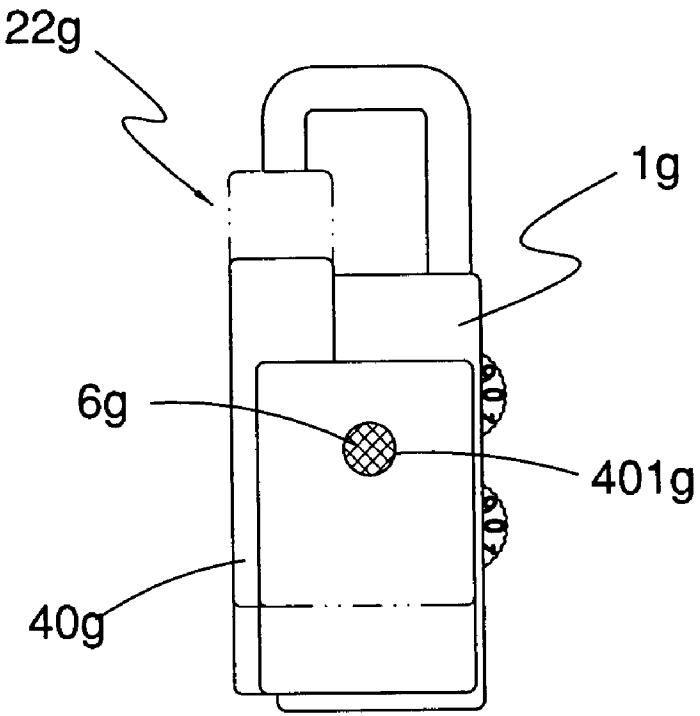
FIG. 23 is a front plan operational view of the padlock as shown in FIG. 22.
Figure 22:
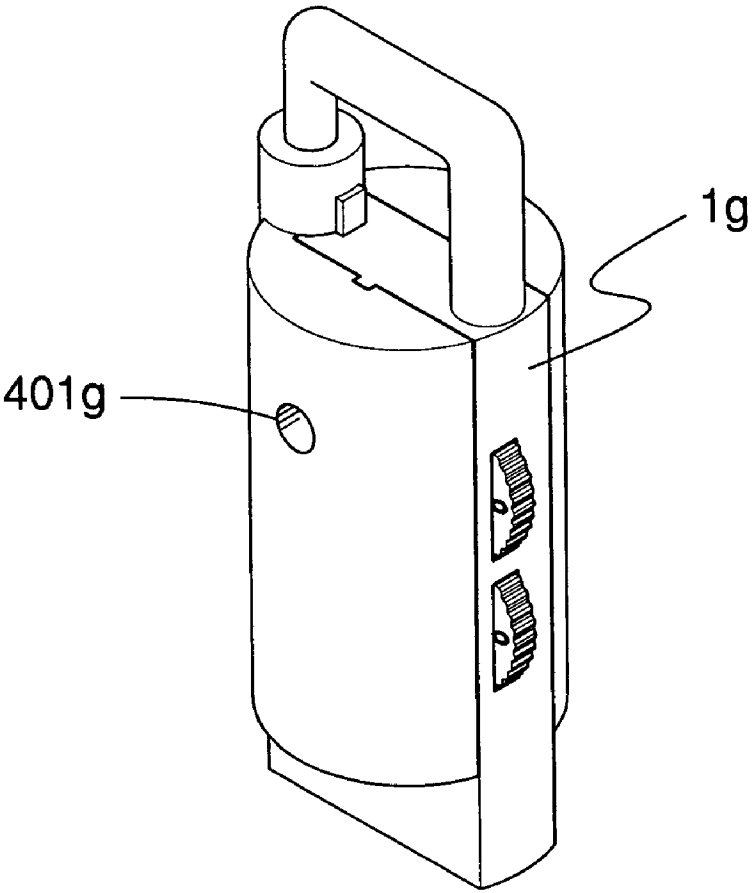
FIG. 22 is a perspective view of a padlock in accordance with the eighth preferred embodiment of the present invention.

Referring to FIGS. 22 and 23, a padlock in accordance with the eighth preferred embodiment of the present invention has a structure substantially similar to that of the first preferred embodiment. The limit knob 40*g* is partially extended from a side of the housing 1*g* and is longitudinally movable on the housing 1*g* to open the gap 22*g* so as to form an unlocked state, so that the identification member 6*g* is moved with the limit knob 40*g* and is exposed outward from the window 401*g* of the limit knob 40*g*.

Figure 24:
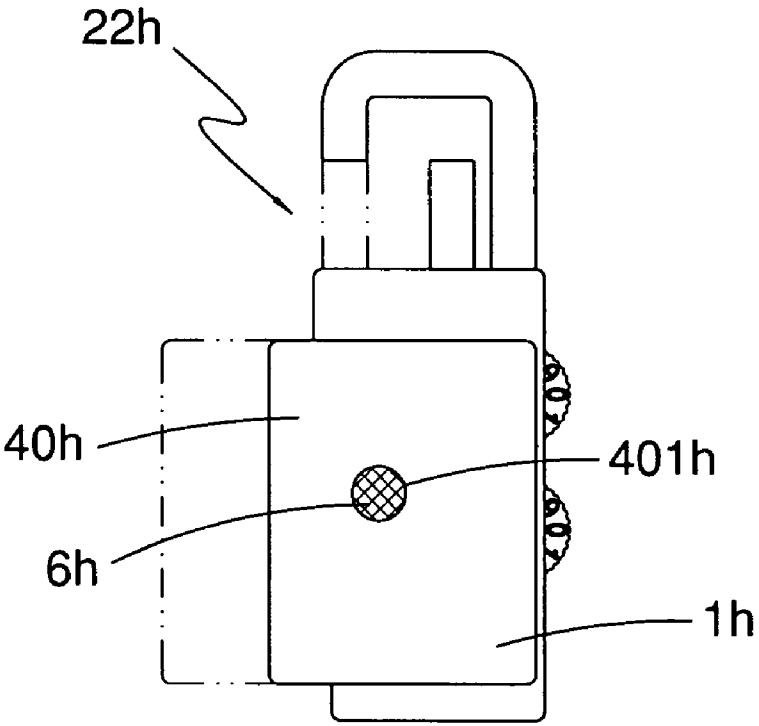
FIG. 24 is a front plan operational view of a padlock in accordance with the ninth preferred embodiment of the present invention.

Referring to FIG. 24, a padlock in accordance with the ninth preferred embodiment of the present invention has a structure substantially similar to that of the eighth preferred embodiment. The limit knob 40*h* is transversely movable on the housing 1*h* to open the gap 22*h* so as to form an unlocked state, so that the identification member 6*h* is moved with the limit knob 40*h* and is exposed outward from the window 401*h* of the limit knob 40*h*.

Figure 25:
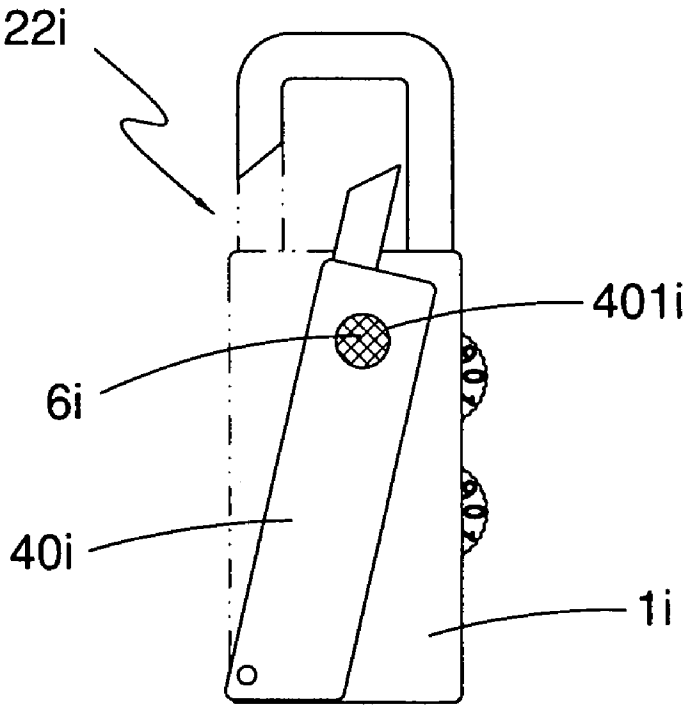
FIG. 25 is a front plan operational view of a padlock in accordance with the tenth preferred embodiment of the present invention.

Referring to FIG. 25, a padlock in accordance with the tenth preferred embodiment of the present invention has a structure substantially similar to that of the first preferred embodiment. The limit knob 40*i* has an end pivotally mounted on a bottom of the housing 1*i*: Thus, the limit knob 40*i* is pivoted on the housing 1*i* to open the gap 22*i* so as to form an unlocked state, so that the identification member 6*i* is moved with the limit knob 40*i* and is exposed outward from the window 401*i* of the limit knob 40*i*.

Accordingly, the identification member is exposed outward from the window of the limit knob after the padlock has been unlocked by an inspector of the customs for checking the luggage so as to remind a user to inspect if contents of the luggage that has been opened and checked are missed or lost. In addition, the user can directly and easily judge if the padlock has been unlocked for checking the luggage, so that the user only needs to inspect the luggage that has been opened and checked without having to inspect the luggage that has never been opened.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A padlock, comprising:

a housing;

a shackle mounted on the housing and having a first end formed with a pivot shaft movably mounted in the housing and a second end formed with a locking portion moved with the pivot shaft and extended outward from the housing;

a number lock mechanism mounted in the housing to lock and unlock the pivot shaft of the shackle;

a key lock mechanism mounted on the housing and including a lock core rotatably mounted in the housing, and a limit knob located outside of the housing and rotated by rotation of the lock core, wherein the limit knob has a window;

a movable block movably mounted in the limit knob of the key lock mechanism, wherein when the limit knob is moved away to release the locking portion of the shackle, the movable block is moved to an identification position synchronously;

an identification member mounted on the movable block and directed toward the window of the limit knob, wherein when the movable block is moved to the identification position thereof, the identification member is aligned with and exposed outward from the window of the limit knob.

2. The padlock in accordance with claim 1, wherein the identification member is selectively chosen from the group of a color, a character, a number and a pattern.

3. The padlock in accordance with claim 1, wherein the limit knob of the key lock mechanism has a receiving recess to receive a distal end of the locking portion of the shackle.

4. The padlock in accordance with claim 1, wherein the limit knob is formed with a chamber facing the housing to receive the movable block.

5. The padlock in accordance with claim 4, wherein:

the limit knob has a shaft hole connected to the chamber;

the movable block has a first side provided with a protruding shaft bolt extended into the shaft hole of the limit knob and a second side provided with a guide portion formed with a first ramp;

the housing is formed with a second ramp complementarily touchable with the first ramp of the guide portion of the movable block.

6. The padlock in accordance with claim 4, wherein:

the limit knob has an arc-shaped guide slot connected to the chamber;

the housing is formed with a limit slot;

the movable block has a first side provided with a first protruding post slidably mounted in the guide slot of the limit knob and a second side provided with a second protruding post slidably mounted in the limit slot of the housing and rested on a terminal side of the limit slot of the housing.

7. A padlock, comprising:

a housing;

a shackle mounted on the housing and having a first end formed with a pivot shaft movably mounted in the housing and a second end formed with a locking portion moved with the pivot shaft and extended outward from the housing, wherein a gap is defined between a distal end of the locking portion of the shackle and the housing;

a number lock mechanism mounted in the housing to lock and unlock the pivot shaft of the shackle;

a key lock mechanism mounted on the housing and including a lock core rotatably mounted in the housing, and a limit knob located outside of the housing and moved by rotation of the lock core, wherein the limit knob has a window and detachably received in the gap;

a movable block movably mounted in the limit knob of the key lock mechanism, wherein when the limit knob is moved away from the gap, the movable block is moved to an identification position synchronously;

an identification member mounted on the movable block and directed toward the window of the limit knob, wherein when the movable block is moved to the identification position thereof, the identification member is aligned with and exposed outward from the window of the limit knob.

8. The padlock in accordance with claim 7, wherein the identification member is selectively chosen from the group of a color, a character, a number and a pattern.

* * * * *